US008465308B2

(12) United States Patent
Gao et al.

(10) Patent No.: US 8,465,308 B2
(45) Date of Patent: Jun. 18, 2013

(54) CONNECTOR HAVING SELF-WIPING CONTACTS

(75) Inventors: Zheng Gao, San Jose, CA (US); Greg Springer, Sunnyvale, CA (US); William Long, Cupertino, CA (US); John Raff, Menlo Park, CA (US); Laura DeForest, Sunnyvale, CA (US)

(73) Assignee: Appple Inc., Cupertino, CA (US)

( * ) Notice: Subject to any disclaimer, the term of this patent is extended or adjusted under 35 U.S.C. 154(b) by 176 days.

(21) Appl. No.: 12/905,397

(22) Filed: Oct. 15, 2010

(65) Prior Publication Data

US 2012/0094517 A1 Apr. 19, 2012

(51) Int. Cl.
*H01R 29/00* (2006.01)

(52) U.S. Cl.
USPC ..... 439/188; 439/489; 439/630

(58) Field of Classification Search
USPC ..... 439/188, 630, 489
See application file for complete search history.

(56) References Cited

U.S. PATENT DOCUMENTS

| | | | | |
|---|---|---|---|---|
| 7,686,633 | B2 * | 3/2010 | Yu et al. | 439/188 |
| 7,837,488 | B2 * | 11/2010 | Wu | 439/188 |
| 7,887,348 | B2 * | 2/2011 | Matsumoto et al. | 439/188 |
| 7,922,507 | B2 * | 4/2011 | Wang et al. | 439/188 |
| 7,927,115 | B2 * | 4/2011 | Sun | 439/159 |
| 8,025,535 | B1 * | 9/2011 | Sun et al. | 439/668 |
| 2006/0116027 | A1 * | 6/2006 | Tseng et al. | 439/630 |

* cited by examiner

*Primary Examiner* — Hien Vu
(74) *Attorney, Agent, or Firm* — Kilpatrick Townsend & Stockton LLP

(57) ABSTRACT

Connectors that may be incorporated and used in electronic devices in a reliable manner. One example may provide a connector that may receive a memory card, such as a Secure Digital, SmartMedia, Compact Flash, or other type of memory card. One example may provide a connector that may connect to other electronic circuits and components in an electronic device in a reliable manner. Another may provide a connector that may reliably form a connection for electromagnetic interference protection during device assembly. Another may provide a connector that may be resistant to damage from debris or other particulate matter that may enter the connector. Another example may provide a connector that has a back that is reinforced to prevent damage caused by the insertion of a card with excessive force. Another may provide a connector having a raised portion arranged to fit in an opening in a printed circuit board.

20 Claims, 9 Drawing Sheets

CONNECTOR HAVING SELF-WIPING CONTACTS

BACKGROUND

The number and types of electronic devices that are available to the public has increased dramatically in the past few years. Tablet, netbook, and laptop computers, printers, cameras, media players, portable media players, smart, media, and cell phones, and other devices have proliferated.

Often these devices have connectors for receiving other electronic devices or connections to other electronic devices. These other electronic devices include removable memory devices. Removable memory devices may be inserted by a user into a connector in an electronic device to increase the memory capacity of the electronic device. For example, "film" in the form of a memory card may be inserted into a camera, where the memory card is used to store photographic images. These removable memory cards may include Secure Digital, SmartMedia, Compact Flash, and other types of memory cards.

The capability to increase memory capacity may be very important for an electronic device. For example, a camera may have little or no internal memory, and may rely solely or primarily on a memory card. If the memory card connector of an electronic device is damaged, the usefulness of the electronic device is diminished.

This damage may occur at different times. For example, a connector may be damaged during electronic device manufacturing. For example, the connector may be damaged when it is connected to other electronic circuits and components in the electronic device, or when it is enclosed in a housing in the electronic device. The connector may also be damaged during device use, either by the environment in which the device is used, or by a user of the device.

Thus, what is needed are connectors that may be incorporated by and used in electronic devices in a reliable manner. For example, it may be useful to have connectors that may be connected to other electronic circuits and components in an electronic device, and enclosed in a device housing without sustaining damage. It may also be useful to have connectors that can be used reliably with a reduced chance of damage from the environment or the electronic device's user.

SUMMARY

Accordingly, embodiments of the present invention may provide connectors that may be incorporated and used in electronic devices in a reliable manner. An illustrative embodiment of the present invention may provide a connector that may receive a memory card, such as a Secure Digital, SmartMedia, Compact Flash, or other type of memory card.

An illustrative embodiment of the present invention may provide a connector that may reliably form a connection for electromagnetic interference (EMI) protection during device assembly. This connector may include one or more fingers that project from a shield or frame. The one or more fingers may make contact with a housing of the electronic device, thereby providing an EMI connection.

Another illustrative embodiment of the present invention may provide a connector that may connect to other electronic circuits and components in an electronic device in a reliable manner. This may be achieved using a structure that prevents solder from wicking into the connector. Specifically, a first portion of a pin on the connector may be soldered to a board or other structure. A second portion of the pin that is connected to the first portion may be surrounded by, and approximately adjacent to, a first portion of a housing of the connector. This first housing portion may limit the amount of flux that wicks along the pin to the second portion of the pin. To further protect the connector, a third portion of the pin connected to the second portion may be surrounded in a cavity in the housing. This allows flux that reaches the third portion to spread and cool, which helps to limit its progress into the connector. The pin may further include a fourth portion, which is surrounded by, and at least approximately adjacent to, a second portion of the connector housing. This second housing portion may limit the progress of any flux that reaches the cavity, thereby protecting the connector from damage.

Another embodiment of the present invention may provide a connector that may attach to a printed circuit board or other substrate in a manner that improves manufacturing reliability while providing a connector and printed circuit board combination that has a reduced height. This connector may include a raised portion. The raised portion may include one or more contacts or switches. The raised portion may fit in a opening or through-hole in the printed circuit board. This arrangement may provide a reduced height as compared to attaching a connector to a surface of a printed circuit board. It may also provide increased strength and reliability as compared to attaching a connector to a cut-away edge of a printed circuit board.

Another illustrative embodiment of the present invention may provide a connector that may be resistant to damage from debris or other particulate matter that may enter the connector. This connector may include a detect switch that engages multiple contacts when closed. The redundancy provided by multiple contacts may allow the detect switch to have one contact become fouled while still providing functionality. This connector detect switch may also engage with a sweeping, lateral motion that may clear debris or other particulate matter from one or more of the multiple contacts. These contacts may also have one or more raised surfaces that are more readily cleaned by this motion.

Another illustrative embodiment of the present invention may provide a connector that has a back that may be reinforced to prevent damage caused by the insertion of a card with excessive force. This connector may incorporate dovetailing or other interlocking structure between connector portions to provide additional strength. This connector may also incorporate additional framing for improved strength.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
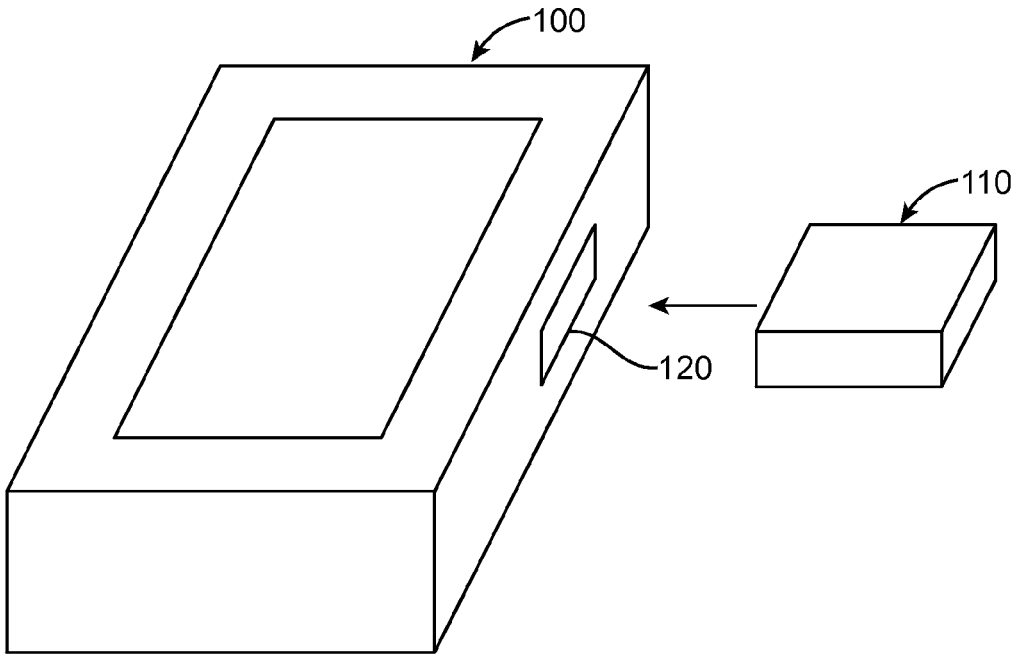
FIG. 1 illustrates an electronic device that is improved by the incorporation of an embodiment of the present invention.

FIG. 1 illustrates an electronic device that is improved by the incorporation of an embodiment of the present invention. This figure includes electronic device 100. Electronic device 100 may be a tablet, netbook, laptop, or other type of computer, cell, media, or smart phone, monitor, media player, or other type of electronic device.

Card 110 may also be included. Card 110 may be a Secure Digital card, SmartMedia card, Compact Flash, or other type of card or electronic device. For example, card 110 may be a Secure Data, miniSD, MultiMedia, or other type of card. Card 110 may be inserted into electronic device 100 using connector receptacle 120.

Connector receptacle 120 may include a shield to provide isolation from electromagnetic interference. This shield may be grounded to reduce electromagnetic interference received or produced by a card in connector receptacle 120. This grounding may be done through a device's enclosure housing or other appropriate grounding surface or connection. A specific embodiment of the present invention may achieve this grounding in a simple manner that requires very few components. This may allow EMI protection in a manner that may provide for reliable manufacturing. An example is shown in the following figure.

Figure 2:
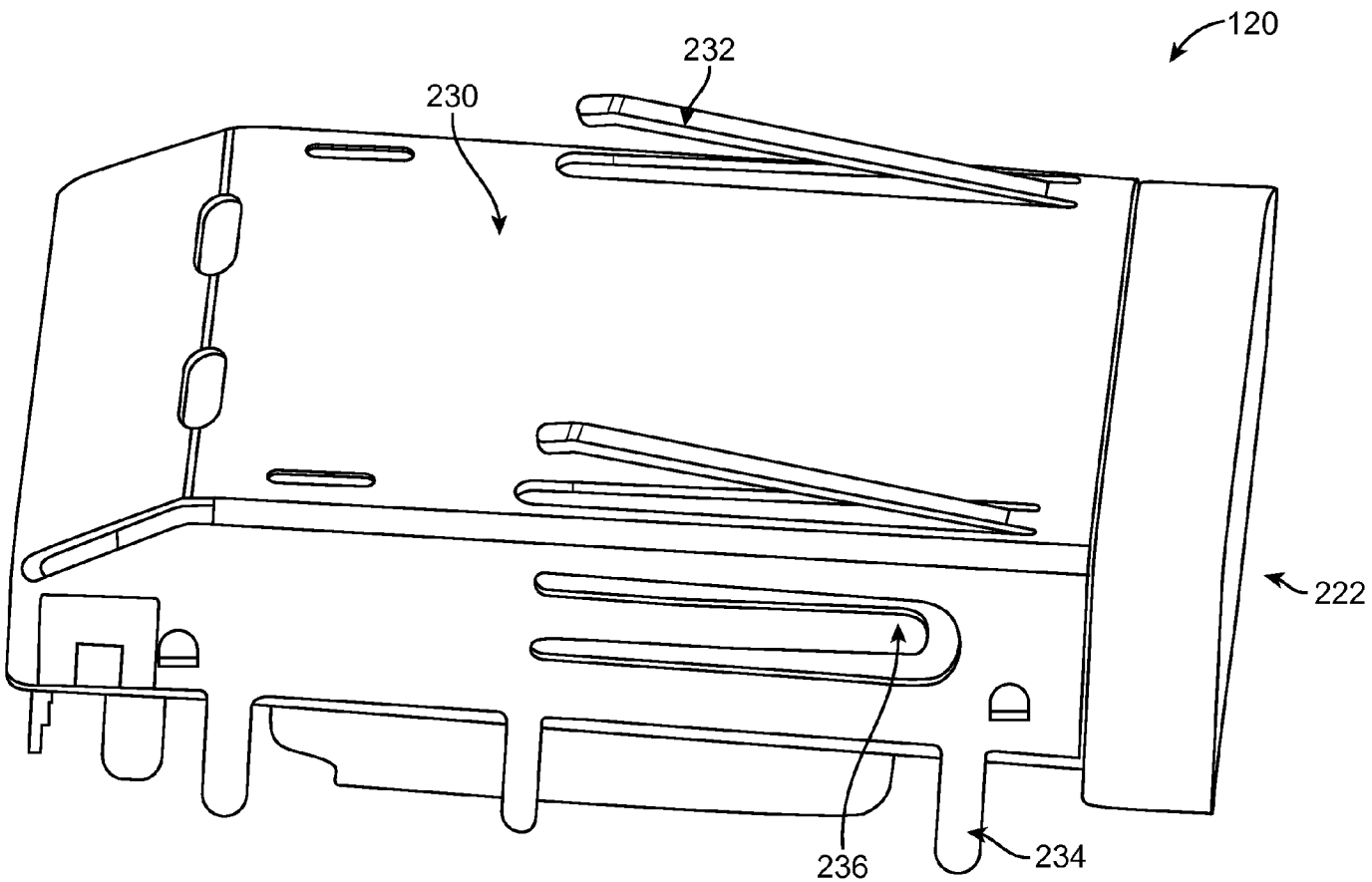
FIG. 2 is a top perspective view of a connector receptacle according to an embodiment of the present invention.

FIG. 2 is a top perspective view of a connector receptacle 120 according to an embodiment of the present invention. This figure, as with the other included figures, is shown for illustrative purposes and does not limit either the possible embodiments of the present invention or the claims.

Connector receptacle 120 may have an opening 222 for receiving a memory card. Connector receptacle 120 may be arranged to receive a Secure Digital card, SmartMedia card, Compact Flash card, or other type of memory card. While embodiments of the present invention are particularly suited to receiving memory cards, other embodiments of the present invention may be arranged to receive other types of electronic devices, or connections to other electronic devices.

Connector 120 may include shield 230. Shield 230 may be used to isolate circuitry in an electronic device that includes connector receptacle 120 from a memory card inserted into connector receptacle 120. That is, shield 230 may protect signals on a memory card inserted into connector receptacle 120 from voltage transients and other noise generated by circuitry in or associated with an electronic device that includes connector receptacle 120. Shield 230 may also isolate circuitry in and associated with an electronic device that includes connector receptacle 120 from voltage transients and noise generated on a memory card inserted into connector receptacle 120.

Shield 230 may surround a housing. Shield 230 may include fingers 232 and 236. One or more fingers 232 may project outwardly away from the housing. When connector receptacle 120 is enclosed in an electronic device, fingers 232 may contact a portion of the electronic device enclosure or other suitable surface. The contact between fingers 232 and the device enclosure or other suitable surface may form a portion of an electromagnetic interference ground path. Since this EMI connection is achieved using very few components, embodiments of the present invention provide a connection to shield 230 that that may be manufactured in a reliable manner.

Finger 236 may provide mechanical support by holding the housing securely inside shield 230. In other embodiments of the present invention, finger 236 may instead project outwardly to contact a portion of the electronic devices housing or other suitable surface or connection. Tabs 234 may be soldered to a printed circuit board, other substrate, or other connection to provide mechanical support.

In various embodiments of the present invention, shield 230 may be formed using steel, stainless steel, copper, brass, aluminum, or other conductive material. Fingers 232 and 236 may be formed by stamping, soldering, or by other method. The housing may be plastic or other nonconductive or insulating material.

Embodiments of the present invention may include a detection switch to detect the presence of a memory card in connector receptacle 120. This may allow circuitry associated with connector receptacle 120 to become active when a card is inserted, for example, in order to read data from and write data to the memory card. An example is shown in the following figure.

Figure 3:
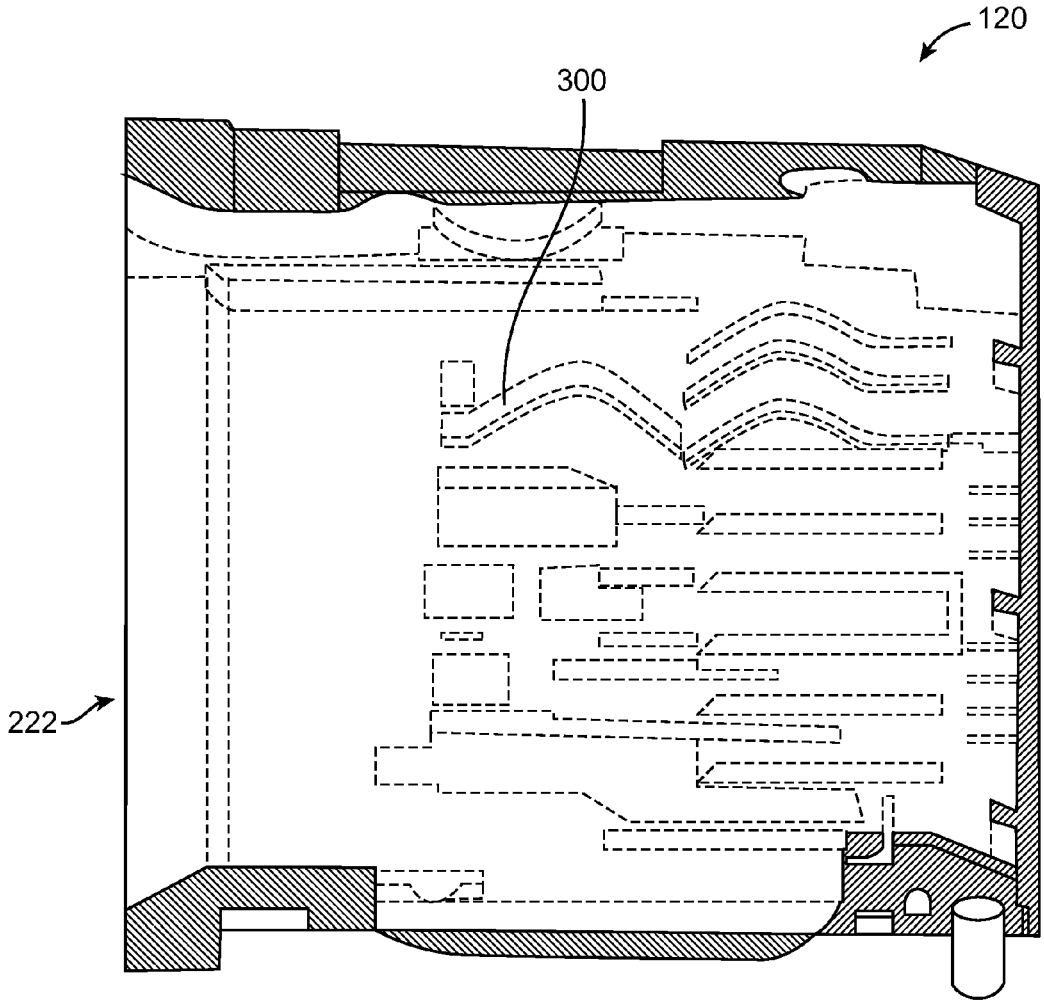
FIG. 3 illustrates a top, cut-away view of a connector receptacle according to an embodiment of the present invention.

FIG. 3 illustrates a top, cut-away view of a connector receptacle 120 according to an embodiment of the present invention. Again, a card may be inserted into opening 222 of connector receptacle 120. When this occurs, insertion contact 300 may be depressed. Insertion contact 300 may then form an electrical connection with one or more contact pins (not shown). The presence of this electrical connection may be used to determine the presence of a card in connector receptacle 120.

Again, embodiments of the present invention may provide connector receptacles that may be connected to other circuitry in an electronic device in a reliable manner. A specific embodiment of the present invention provides a connector that may be soldered to a board or other connector or substrate. This connector may include a contact pin for a detection switch, where the contact pin may be soldered to a board in a reliable manner. This contact pin may have a reduced susceptibility to solder flux wicking into a contact area and thereby damaging the connector. An example is shown in the following figure.

Figure 4:
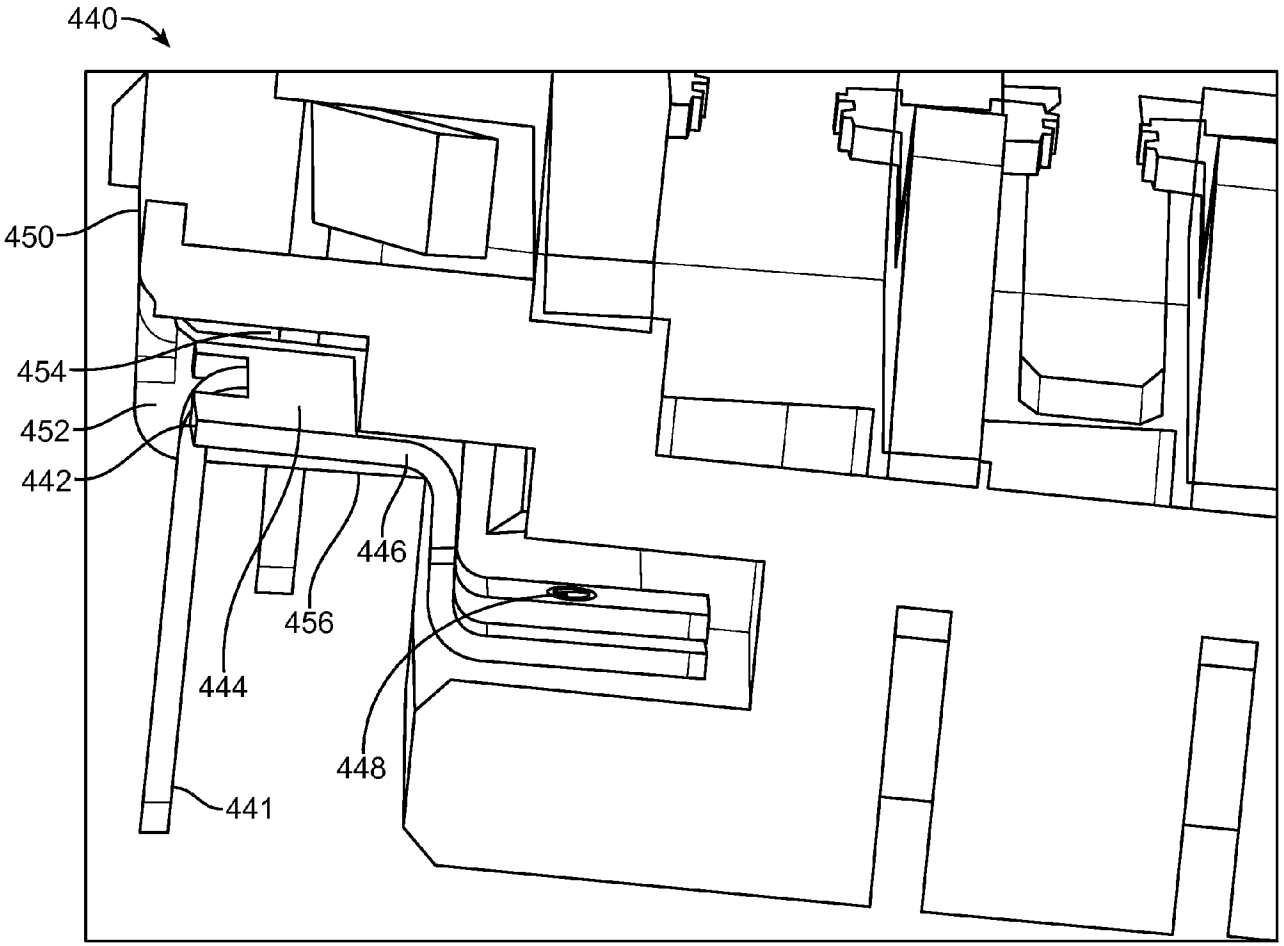
FIG. 4 illustrates a portion of a connector receptacle according to an embodiment of the present invention.

FIG. 4 illustrates a portion of a connector receptacle 120 according to an embodiment of the present invention. The connector receptacle portion includes contact pin 440. Contact pin 440 may further include a first portion 441. First portion 441 may be arranged to be soldered into a through-hole in a printed circuit board or other board or connector. In other embodiments the present invention, first portion 441 may be a surface mount or other type of connection.

Contact pin 440 may include a second portion 442. Second portion 442 may be surrounded by, and at least approximately adjacent to, a first housing portion 452. That is, the housing may be formed around contact pin 440 using injection molding or other appropriate technique. As the housing cools, first housing portion 452 may pull away from contact pin 440. This may leave a gap between first housing portion 452 and contact pin 440. Also, mechanical stress between the housing and contact pin 440 may form or increase a gap between first housing portion 452 and contact pin 440. For these reasons, first housing portion 452 may not be in direct contact with contact pin 440, though it may, but rather contact pin 440 may be only at least approximately adjacent to first housing portion 452.

As first portion 441 of contact pin 440 is soldered into a board, solder flux may wick through an opening between second portion of pin 442 and housing portion 452. This wicking may result due to capillary action. Solder flux that flows through the opening between second pin portion 442 and first housing portion 452 may reach a third portion of contact pin 440, specifically surface 444. Surface 444 may be located in cavity 454 in the housing. As flux reaches this opening, it may cool and solidify. This may prevent the flux from progressing further.

Contact pin 440 may further include a fourth portion 446. Fourth portion 446 may be surrounded by, and at least approximately adjacent to, a second portion of housing 456. Again, a narrow opening between fourth portion 446 of contact pin 440 and second housing portion 456 may prevent flux from proceeding further into connector receptacle 120. Contact pin 440 may further include one or more contact areas 448. Contacts 448 may come in contact with insertion contact 300 when a card is inserted into connector receptacle 120.

Embodiments of the present invention may provide connector receptacles that are able to operate reliably during use. For example, embodiments of the present invention may provide features that allow a detection switch to remain functional in the event that debris or particulate matter enters the connector receptacle. One specific embodiment of the present invention may provide multiple contacts for redundancy. When one contact is disabled or fouled, another may provide an electrical connection to allow a detection switch to remain functional. Another specific embodiment of the present invention may provide a detection switch that closes with a lateral, sweeping motion that clears debris or particulate matter from one or more contacts. Examples are shown in the following figures.

Figure 5:
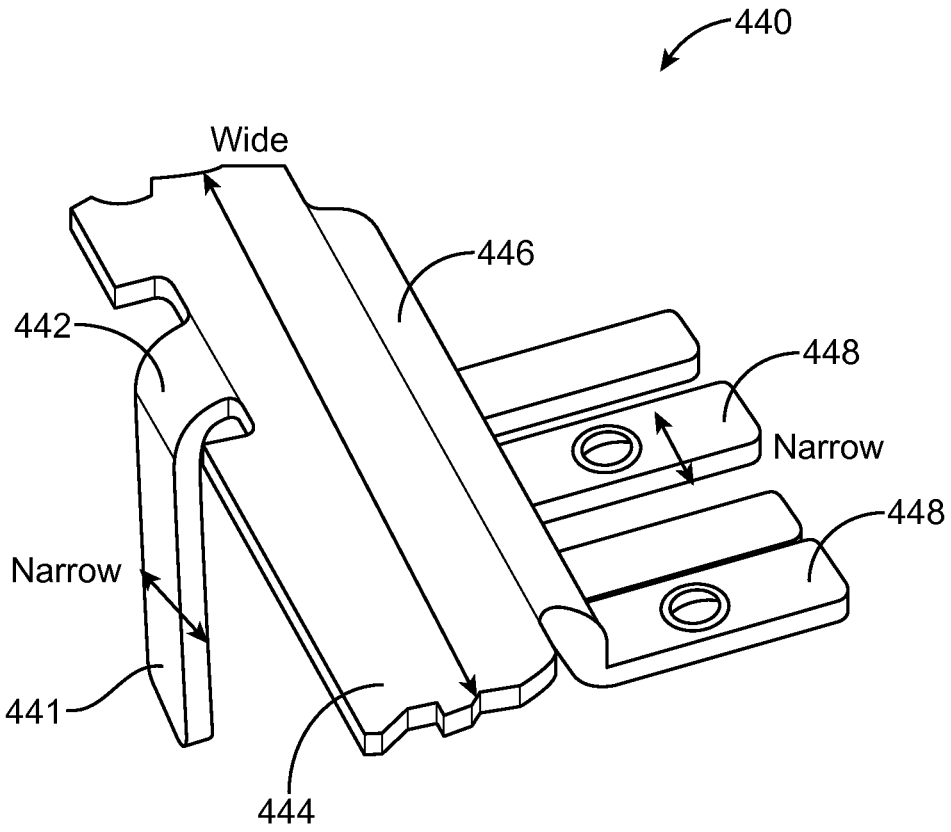
FIG. 5 illustrates a top perspective view of a contact pin according to an embodiment of the present invention.

FIG. 5 illustrates a top perspective view of contact pin 440. Again, contact pin 440 may include a first portion 441. First portion 441 may be arranged to be soldered to a printed circuit board, or other appropriate substrate or connector. Contact pin 440 may include a second portion 442. Second portion 442 may be surrounded by, and at least approximately in contact with, a first portion of a housing (not shown).

Contact pin 440 may further include a third portion 444. At least a portion of a surface of third portion 444 may be in a cavity in the housing. Again, as solder flux flows up past second portion 442, it may reach the cavity and cool. This may in turn limit the flux's forward progress. Third portion 444 may also be wide compared to first and second portions 441 and 442, which may help to further spread and cool the flux during electronic device assembly.

Contact pin 440 may further have a fourth portion 446. Fourth portion 446 may be surrounded by, and at least approximately in contact with, a second portion of the housing. Fourth portion 446 may be narrower than third portion 444. This provides a relatively small opening to the contact area, thereby further limiting the solder flux's progress. Contact pin 440 may further include contact areas 448. Contact areas 448 may make electrical contact with insertion contact 300 when a card is inserted into connector receptacle 120.

In various embodiments of the present invention, contact pin 440 and insertion contact 300 may be formed using steel, stainless steel, copper, brass, aluminum, or other conductive material.

Figure 6:
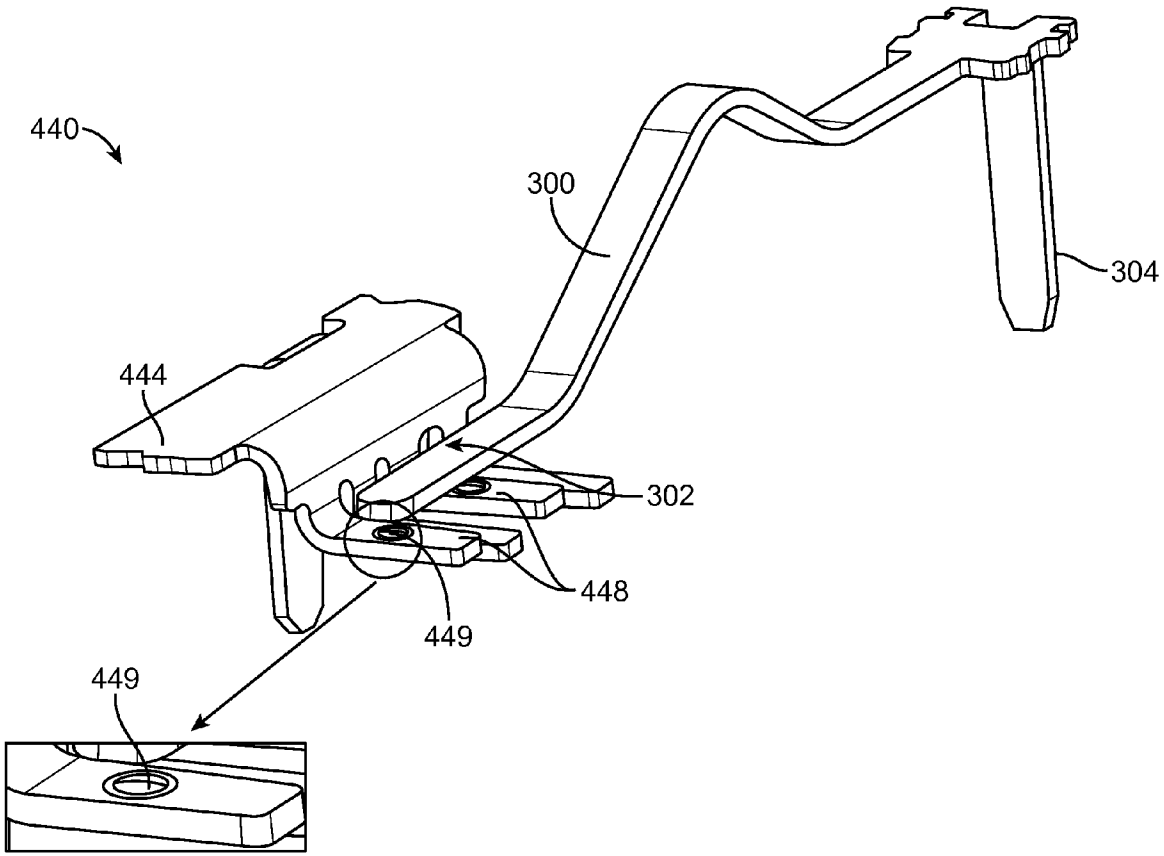
FIG. 6 illustrates a side perspective view of a detection switch according to an embodiment of the present invention.

FIG. 6 illustrates a side perspective view of detection switch according to an embodiment of the present invention. The detection switch includes a portion of contact pin 440 and insertion contact 300. Insertion contact 300 may include a portion 304 that may be connected to a printed circuit board or other substrate or connector. Portion 304 may be arranged to be soldered into a through-hole connection of a printed circuit board, or other substrate or connection. In other embodiments of the present invention, portion 304 may be a surface mount connection.

Again, as a card is inserted into connector receptacle 120, insertion contact 300 may be pushed downward, such that contacting portion 302 may form electrical connections with contacts 448. This downward motion may also include a lateral motion. This lateral motion may assist in removing debris or particulate matter that may enter connector receptacle 120 and prevent an electrical connection between insertion contact 300 and one or more of the contacts 448. Specifically, as a card is inserted into connector receptacle 120, a leading edge of the card may contact insertion contact 300. This may cause contact portion 302 to move down and across contacts 448. Particulate matter or debris that may be located between contacts 448 and contacting portion 302 may be swept away, which may allow contact between contact portion 302 and contacts 448.

In this example, contacts 448 include a raised or dimpled portion 449. In other embodiments of the present invention, other types of raised portions may be used. Also, in this example, two contacts 448 are shown. In other embodiments of the present invention, other numbers of contacts 448 may be employed. For example, one, three, or other numbers of contacts 448 may be included.

Figure 7:
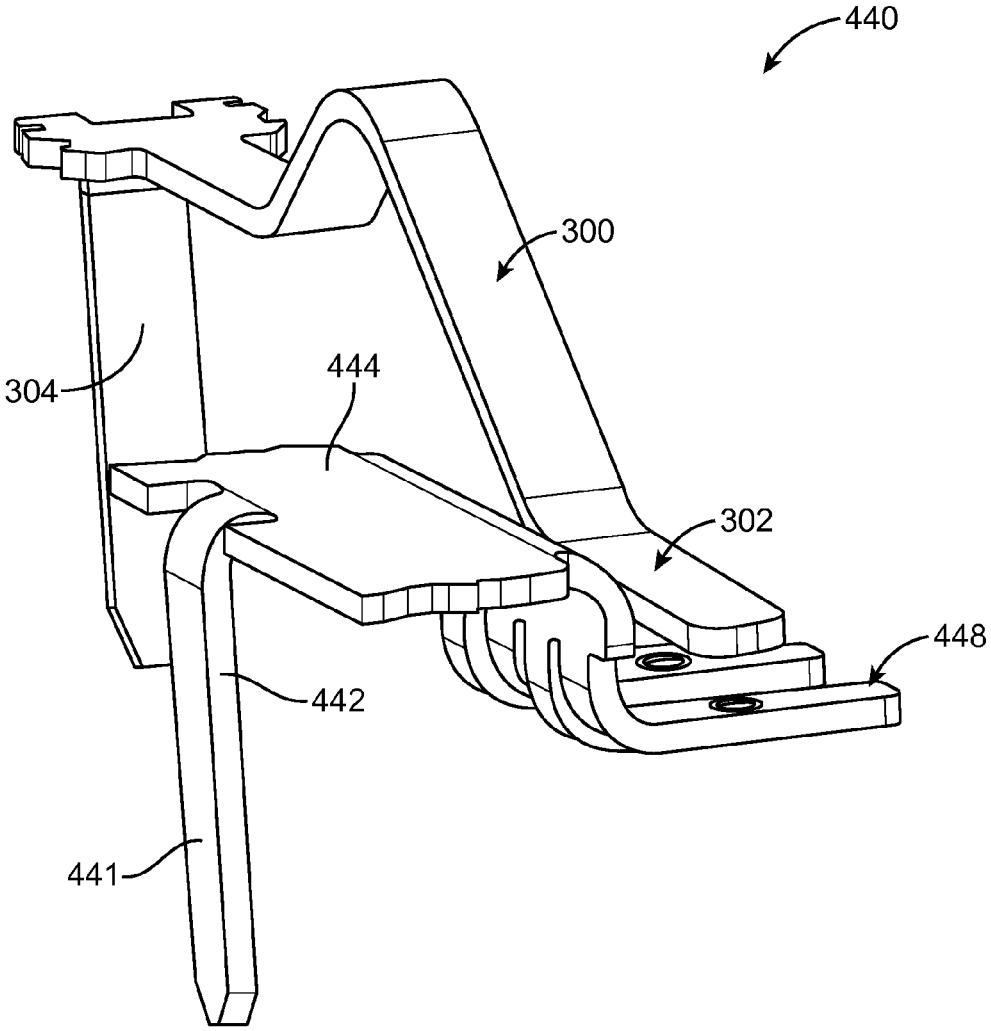
FIG. 7 illustrates a front perspective view of a detection switch according to an embodiment of the present invention.

FIG. 7 illustrates a front perspective view of a detection switch according to an embodiment of the present invention. This detection switch may include insertion contact 310 and contact pin 440.

Further embodiments of the present invention may reinforce a back of a connector receptacle. This may prevent damage to the back of a connector receptacle in the event that a memory card is inserted into the connector receptacle with excessive force. An example is shown in the following figure.

Figure 8:
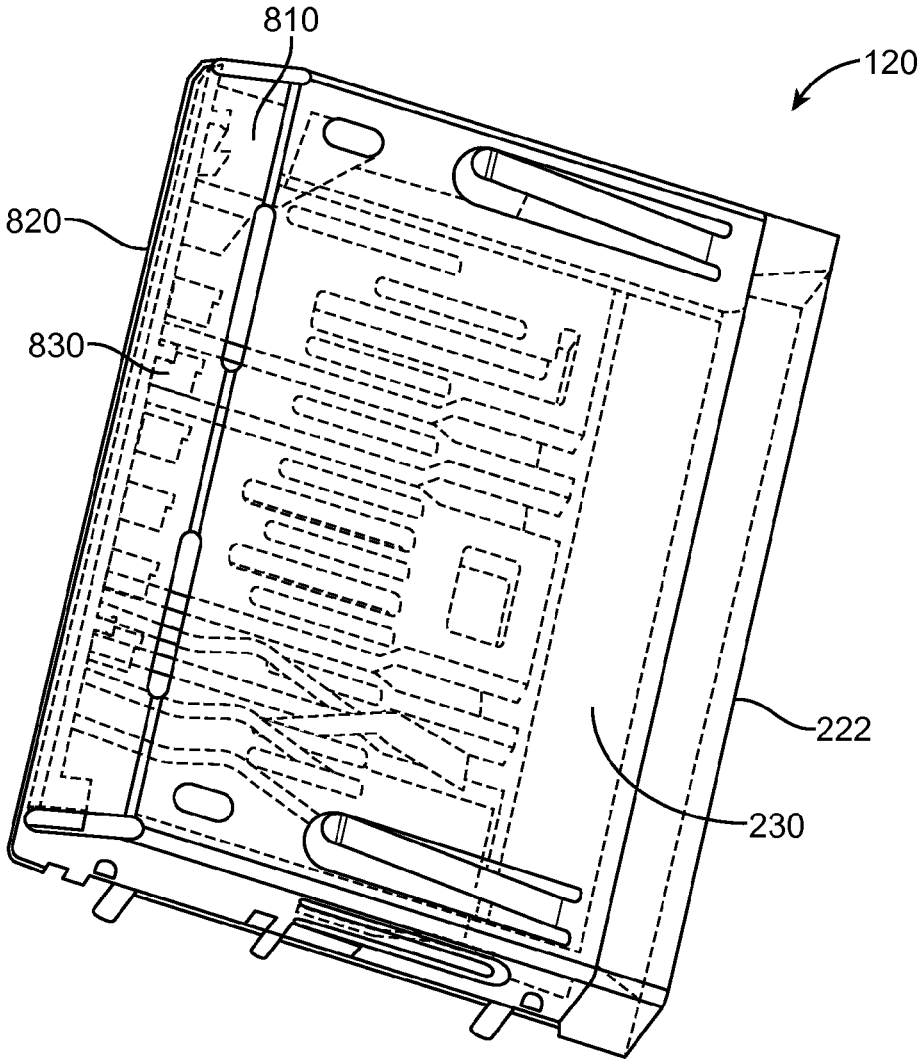
FIG. 8 illustrates the reinforcement for a back of a connector receptacle that may be employed by embodiments of the present invention.

FIG. 8 illustrates the reinforcement for a back of a connector receptacle that may be employed by embodiments of the present invention. FIG. 8 illustrates connector receptacle 120 having opening 222. Again, a memory card may be inserted by a user into opening 222.

Connector receptacle 120 may include a top housing portion 830 and a bottom housing portion 820. These housing portions may be connected in an interlocking manner. For example, portions of top housing portion 830 may extend outwardly and mate with gaps in bottom housing portion 820 This interlocking may provide reinforcement to protect back 810 of connector receptacle 120 from excessive insertion force. In this specific example, the interlocking pattern is a dovetail pattern, though in other embodiments of the present invention, other patterns may be used. This interlocking portion may be reinforced, for example by a metal portion. In a specific embodiment of the present invention, shield 230 provides reinforcement for the interlocking pattern between top housing portion 830 and bottom housing portion 820.

Further embodiments of the present invention may provide connector receptacles that may attach to a printed circuit board in a manner that reduces the total height of the resulting connector receptacle and printed circuit board combination. These embodiments may achieve this without significantly reducing the strength of the printed circuit board, thereby improving the manufacturing and operational reliability of the connector receptacle. An example is shown in the following figure.

Figure 9:
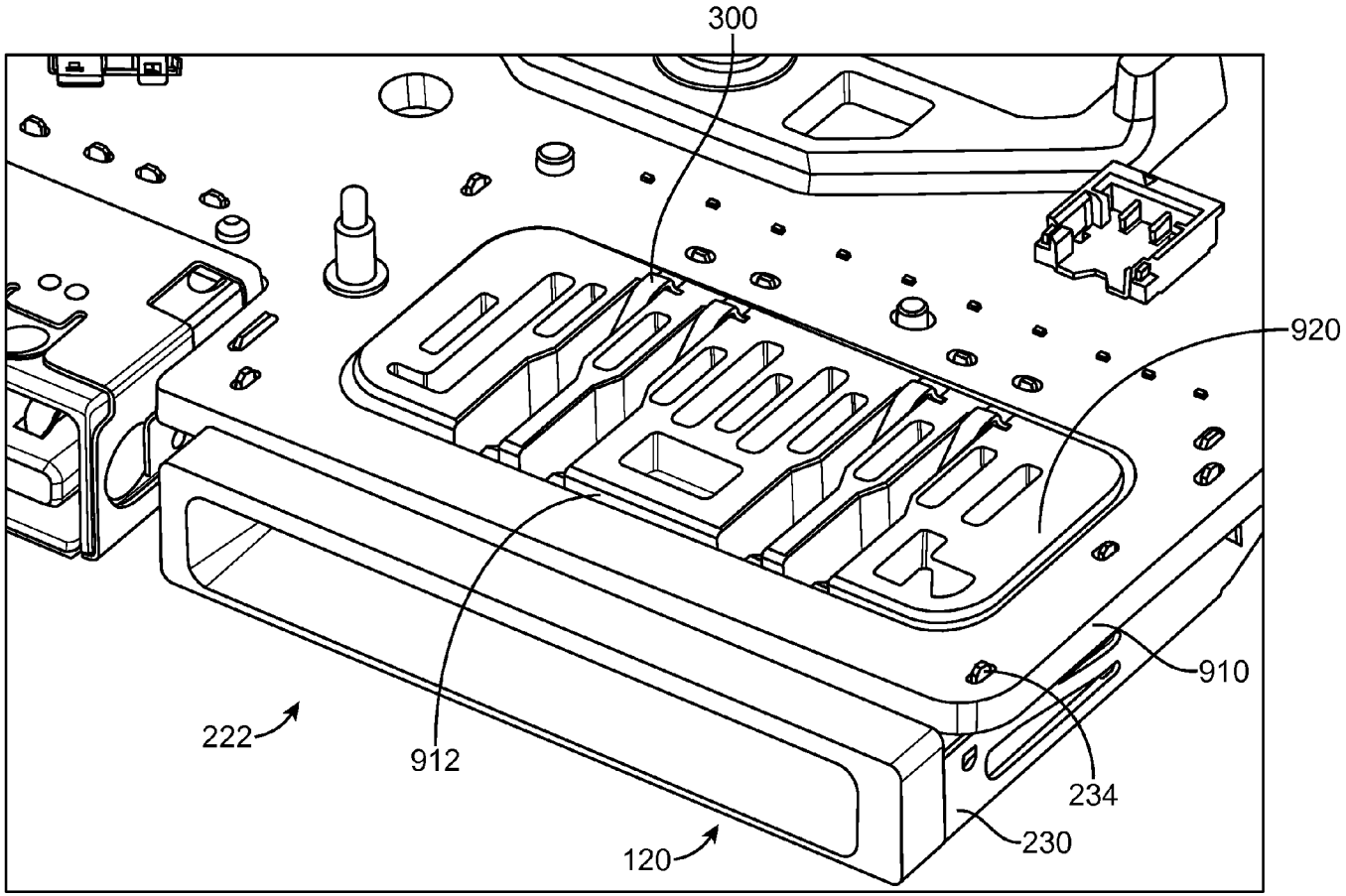
FIG. 9 illustrates a connector receptacle having a raised portion arranged to fit in an opening or through-hole of a printed circuit board according to an embodiment of the present invention.

FIG. 9 illustrates a connector receptacle having a raised portion arranged to fit in an opening or through-hole of a printed circuit board according to an embodiment of the present invention. Connector receptacle 120 includes a raised portion 920. Raised portion 920 may include contacts (not shown) for mating with contacts on a card inserted into opening 222 of connector receptacle 120, as well as insertion contacts 300. Raised portion 920 may fit into opening 912 of printed circuit board 910. This arrangement may provide a reduced height as compared to attaching a connector to a surface of a printed circuit board. It also may provide increased strength and reliability as compared to attaching a connector to a cut-away edge of a printed circuit board.

Again, shield 230 may include tabs 234. Tabs 234 may insert in through-holes in printed circuit board 910. Tabs 234 may be soldered or otherwise connected to printed circuit board 910 for mechanical stability.

In this example, connector receptacle 120 is attached to printed circuit board 910. In other embodiments of the present invention, connector receptacle 120 may attach to another type of substrate or connector, such as a flexible circuit board. Also, while four insertion contacts 300 are shown, other embodiments of the present invention may employ other numbers of insertion contacts 300, such as one, two, three, or more than four insertion contacts 300.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:
a housing; and
a contact pin of a detect switch comprising:
a first portion;
a second portion connected to the first portion, the second portion surrounded by, and at least approximately adjacent to, a first portion of the housing;
a third portion connected to the second portion, and surrounded by a cavity in the housing; and
a fourth portion connected to the third portion, the fourth portion surrounded by, and at least approximately adjacent to, a second portion of the housing,
wherein the housing comprises a top housing portion and a bottom housing portion, and the to housing portion and the bottom housing portion are connected using an interlocking arrangement and the interlocking arrangement is reinforced with a metal portion.

2. The connector of claim 1 wherein the contact pin is connected to at least one contact of an insert contact of the detect switch.

3. The connector of claim 2 wherein the detect switch is closed when a card is inserted into the connector.

4. The connector of claim 1 wherein the first portion of the contact pin is arranged to be soldered to a board.

5. The connector of claim 1 wherein the housing is plastic.

6. The connector of claim 1 wherein the second portion of the contact pin is between the first portion of the contact pin and the third portion of the contact pin.

7. The connector of claim 6 wherein the third portion of the contact pin is between the second portion of the contact pin and the fourth portion of the contact pin.

8. The connector of claim 1 wherein the contact pin further comprises a contact portion connected to the fourth portion.

9. The connector of claim 1 wherein the contact pin further comprises two contact portions connected to the fourth portion.

10. The connector of claim 9 wherein the two contact portions each comprise a raised portion.

11. The connector of claim 9 wherein the two contact portions each comprise a dimpled portion.

12. The connector of claim 1 further comprising a shield surrounding the housing, the shield having a finger extending away from the housing.

13. The connector of claim 1 wherein the housing comprises a top housing portion and a bottom housing portion, and the top housing portion and the bottom housing portion are connected using a dovetail arrangement.

14. A connector comprising:
a housing; and
a detect switch located in the housing to detect an insertion of a memory card into the connector, the detect switch comprising:
a first contact;
a second contact electrically connected to the first contact; and
a switch portion extended from an insert contact to move and engage the first contact and the second contact when a memory card is inserted,
wherein the housing comprises a top housing portion and a bottom housing portion, and the top housing portion and the bottom housing portion are connected using an interlocking arrangement and the interlocking arrangement is reinforced with a metal portion.

15. The connector of claim 14 wherein when the switch portion engages the first contact and the second contact, the switch portion moves laterally across the first contact and the second contact.

16. The connector of claim 15 wherein the two contact portions each comprise a dimpled portion.

17. The connector of claim 14 further comprising a contact pin, the contact pin comprising:
a first portion;
a second portion connected to the first portion, the second portion surrounded by, and at least approximately adjacent to, a first portion of the housing;
a third portion connected to the second portion, and surrounded by a cavity in the housing; and
a fourth portion connected to the third portion, the fourth portion surrounded by, and at least approximately adjacent to, a second portion of the housing, the fourth portion in electrical contact with the first contact and the second contact.

18. The connector of claim 14 further comprising a shield surrounding the housing, the shield having a finger extending away from the housing.

19. A connector comprising:
a top housing portion;
a bottom housing portion having a raised portion including at least one insertion contact;
a shield around at least a portion of the top housing portion and the bottom housing portion, the shield comprising a finger, the finger extending away from the top and bottom housing portions,
wherein the top housing portion and the bottom housing portion are connected using an interlocking arrangement and the interlocking arrangement is a dovetail arrangement, and wherein the raised portion of the bottom housing portion is arranged to fit in an opening in a printed circuit board.

20. The connector of claim 19 further comprising a detect switch to detect an insertion of a memory card into the connector, the detect switch comprising:

a first contact;

a second contact electrically connected to the first contact; and a switch portion to move and engage the first contact and the second contact when a memory card is inserted, wherein at least a portion of the switch portion is located in the raised portion of the second housing portion.

* * * * *